US010790101B2

(12) United States Patent
Yu

(10) Patent No.: US 10,790,101 B2
(45) Date of Patent: Sep. 29, 2020

(54) KNOB WITH DISPLAY FUNCTION

(71) Applicant: Defond Electech Co., Ltd., Dongguan (CN)

(72) Inventor: Chung Yiu Brian Yu, Dongguan (CN)

(73) Assignee: Defond Electech Co., Ltd., Dongguan (CN)

( * ) Notice: Subject to any disclaimer, the term of this patent is extended or adjusted under 35 U.S.C. 154(b) by 82 days.

(21) Appl. No.: 16/218,028

(22) Filed: Dec. 12, 2018

(65) Prior Publication Data

US 2019/0189368 A1 Jun. 20, 2019

(51) Int. Cl.

| | |
|---|---|
| ***H01H 25/06*** | (2006.01) |
| ***H01H 9/18*** | (2006.01) |
| ***H01H 19/14*** | (2006.01) |
| ***H01H 13/06*** | (2006.01) |
| ***H01H 13/14*** | (2006.01) |
| ***H01H 19/06*** | (2006.01) |
| ***H01H 19/02*** | (2006.01) |

(52) U.S. Cl.

CPC ..... *H01H 9/18* (2013.01); *H01H 9/181* (2013.01); *H01H 13/06* (2013.01); *H01H 13/14* (2013.01); *H01H 19/025* (2013.01); *H01H 19/06* (2013.01); *H01H 19/14* (2013.01); *H01H 25/06* (2013.01); *H01H 25/065* (2013.01)

(58) Field of Classification Search

CPC ..... H01H 25/06; H01H 25/065; H01H 9/181; H01H 9/18; H01H 19/025; H01H 19/14

See application file for complete search history.

(56) References Cited

U.S. PATENT DOCUMENTS

| | | | | |
|---|---|---|---|---|
| 5,607,611 | A * | 3/1997 | Lee | G01D 5/25 219/702 |
| 7,141,748 | B2 * | 11/2006 | Tanaka | H01H 9/181 200/310 |
| 7,579,559 | B2 * | 8/2009 | Schelbert | B60K 37/06 200/4 |
| 8,796,566 | B2 * | 8/2014 | Kerner | H01H 19/11 200/4 |
| 8,967,021 | B2 * | 3/2015 | Hisada | H01H 19/14 74/553 |
| 9,911,556 | B2 * | 3/2018 | Lee | H01H 9/181 |
| 10,020,137 | B2 * | 7/2018 | Shitanaka | H01H 25/06 |
| 10,535,478 | B1 * | 1/2020 | Chu | H01H 19/54 |
| 2015/0221462 | A1 * | 8/2015 | Chu | H01H 19/025 200/11 R |

* cited by examiner

*Primary Examiner* — Felix O Figueroa
(74) *Attorney, Agent, or Firm* — Wang Law Firm, Inc.

(57) ABSTRACT

A knob with a display function includes a chassis with a knob ring and a rotary sensor. A display screen, a control circuit board, a reset device and a functional connection board are sequentially installed onto the chassis. A circuit board bracket is installed between the display screen and the control circuit board. The functional connection board has a confirm button, a connection terminal disposed on the back of the functional connection board. The reset device has a through hole for extending the confirm button to the outside, an end abutting and connecting the control circuit board and the other end abutting and connecting the functional connection board. This invention has the features of simple structure and reasonable design and selects a function by turning the knob ring. With the reset device, the application of the invention has high reliability and provides easy identification.

8 Claims, 4 Drawing Sheets

KNOB WITH DISPLAY FUNCTION

FIELD OF THE INVENTION

The present invention relates to the field of switches of electric appliances, and more particularly to a knob with a display function.

BACKGROUND OF THE INVENTION

Home appliances used as a kind of electric appliances at home or similar places come with a wide variety and mainly include large home appliances such as refrigerators, washers, air-conditioners, televisions, etc and small home appliances such as microwave ovens, rice cookers, etc. Moreover, with the rapid development of technology, the shape of home appliances becomes more fashionable, and higher technological sense, and in terms of functionality, the level of modernization and intelligence becomes higher and higher, so that the home appliances are profoundly welcome by the younger group of consumers.

No matter which kind of home appliances are used, buttons or knobs are installed to the home appliances and provided for users to operate the home appliances. In general, the conventional knob or switch cannot be turned at different stages and does not have the display function, or simply provides a label or markings on the switch to indicate or distinguish the functional status. In this way, the positioning during the rotation of the conventional knob or switch cannot be easily known from the appearance of the knob or switch, particularly in a gloomy environment.

In view of the aforementioned drawbacks of the prior art, the inventor of the present invention based on years of experience in the related industry to conduct extensive research and experiment, and finally provided a feasible solution to overcome the drawbacks of the prior art.

SUMMARY OF THE INVENTION

Therefore, it is a primary objective of the present invention to overcome the aforementioned drawbacks of the prior art by providing a knob with a display function and having the features of simple structure, reasonable design, reliable use, and convenient identification.

To achieve the aforementioned and other objectives, the present invention provides a knob with a display function, comprising: a chassis, a knob ring rotatably coupled to the chassis, a rotary sensor coupled to the knob ring, and the chassis comprising a display screen, a control circuit board, a reset device and a functional connection board sequentially installed on the chassis; a circuit board bracket installed between the display screen and the control circuit board, and both of the display screen and the control circuit board being fixed to the circuit board bracket, and the circuit board bracket being movably sheathed and coupled into the knob ring.

The functional connection board has a confirm button embedded thereon, and a connection terminal embedded at the back of the functional connection board and electrically coupled to the confirm button.

The reset device has a through hole for extending the confirm button to the outside, an end abutting and connecting the control circuit board, and the other end abutting and connecting the functional connection board.

The display screen and the rotary sensor being electrically coupled to the control circuit board.

Wherein, the chassis has a light guide ring sheathed on and installed around the periphery of the chassis and electrically coupled to the control circuit board.

Wherein, the chassis has a connection hole formed thereon for passing through the connection terminal.

Wherein, the functional connection board has at least three positioning notches arranged with a gap apart from each other and positioned around the functional connection board, and the chassis has at least three positioning blocks positioned thereon and configured to be corresponsive to the positioning notches respectively, and the chassis further has a buckle for fastening the functional connection board.

Wherein, the reset device has a plurality of positioning sockets distributed uniformly thereon, and each positioning socket has an elastic reset element installed therein, and the elastic reset element has an end coupled to the control circuit board and the other end coupled to the functional connection board.

Wherein, the display screen has a transparent cover installed thereon, and the knob ring has an annular ridge configured therein for preventing the transparent cover from falling off.

Wherein, the knob ring has an annular groove formed therein and provided as a moving space of the circuit board bracket.

Wherein, the chassis has a plug column configured at the bottom of the chassis, a plug block configured symmetrically on each of both sides of the plug column, and a hook portion configured on each plug block.

The present invention has the following advantages: The present invention provides a knob with a display function and the features of simple structure and reasonable design. The invention is applicable for electronic products or electric appliances to control the on or off function of the products or adjusting different functions of the products to provide a multi-stage functional change, wherein the rotary sensor is rotated by the rotation of the knob ring, so that every rotational positioning generates different encoded signals which will be sent to the control circuit board. When the display screen is pressed, the control circuit board triggers the confirm button to select a function, so as to select the function of the end products. In the meantime, contents such as the functions or parameters of the end products are displayed in the display screen according to the different encoded signals generated by each rotational positioning of the knob ring. Wherein, the functional connection board is electrically coupled to an external electric appliance through the connection terminal, so that the confirm button may be pressed to select a function. Wherein, a reset device is installed between the control circuit board and the functional connection board providing reset function to the control circuit board after the confirm button is pressed and preventing the control circuit board from abutting and connecting the confirm button to select a function all the time, and thus providing high reliability.

DESCRIPTION OF THE PREFERRED EMBODIMENTS

Figure 1:
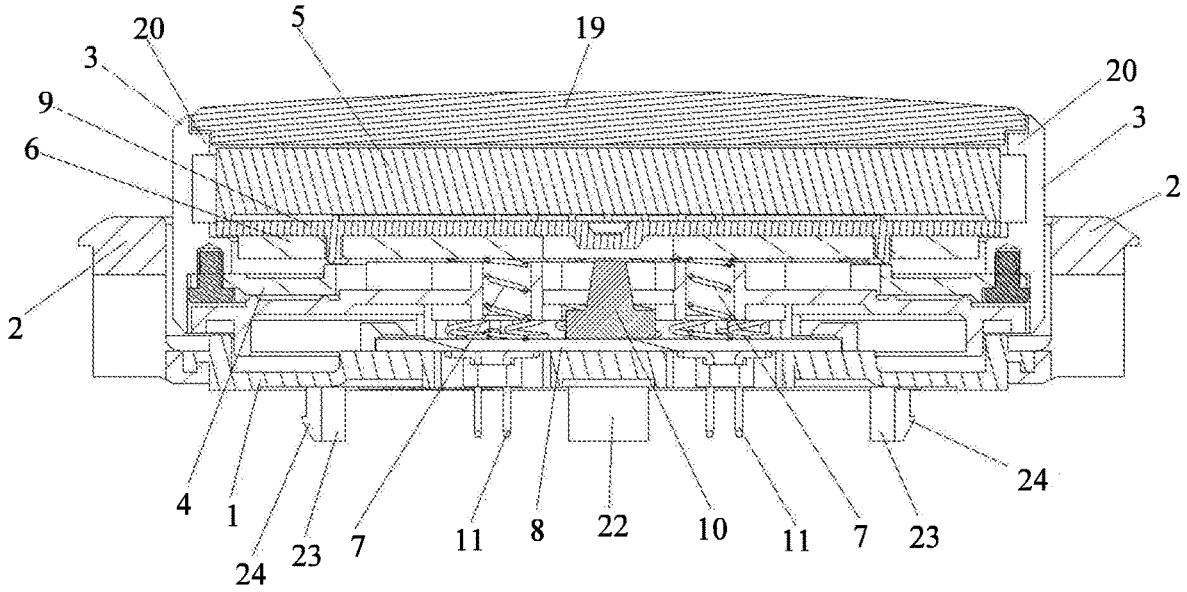
FIG. 1 is a cross-sectional view of a knob with a display function in accordance with the present invention.

The present invention will become more fully understood from the following detailed description of a preferred but non-limiting embodiment thereof, described in connection with the accompanying drawings. It is intended that the embodiments and figures disclosed herein are to be considered illustrative rather than restrictive.

With reference to FIGS. 1 to 4 for a knob with a display function in accordance with an exemplary embodiment of the present invention, the knob with a display function comprises a chassis 1, a knob ring 3 rotatably coupled to the chassis 1, a rotary sensor 4 coupled to the knob ring 3, a display screen 5, a control circuit board 6, a reset device 7 and a functional connection board 8 sequentially installed onto the chassis 1, and a circuit board bracket 9 installed between the display screen 5 and the control circuit board 6, wherein the display screen 5 and the control circuit board 6 are fixed to the circuit board bracket 9, and the circuit board bracket 9 is movably sheathed on and coupled into the knob ring 3.

The functional connection board 8 has provided a confirm button 10, and a connection terminal 11 is embedded at the back of the functional connection board 8, and the connection terminal 11 is electrically coupled to the confirm button 10.

The reset device 7 has a through hole 12 for extending the confirm button 10 to the outside, an end abutting and connecting the control circuit board 6, and the other end abutting and connecting the functional connection board 8.

The display screen 5 and the rotary sensor 4 are electrically coupled to the control circuit board 6.

The present invention has the features of simple structure and reasonable design, and the invention may be applied to electronic products or electric appliances to control the on/off function of the end-products or adjusting different functions of the products to provide a multi-stage functional change. Wherein, the rotary sensor 4 is rotated by the rotation of the knob ring 3, so that every rotational positioning generates a different encoded signal which will be sent to the control circuit board 6. When the display screen 5 is pressed, the control circuit board 6 triggers the confirm button 10 to select a function, so as to select the function of the end products. In the meantime, contents such as the functions or parameters of the end products are displayed in the display screen 5 according to the different encoded signal generated by each rotational positioning of the knob ring 3. Wherein, the functional connection board 8 is electrically coupled to an external electric appliance through the connection terminal 11, so that the confirm button may be pressed to select a function. Wherein, a reset device 7 is installed between the control circuit board 6 and the functional connection board 8 providing resetting function to the control circuit board 6 after the confirm button 10 is pressed, and preventing the control circuit board 6 from abutting and connecting the confirm button 10 to select a function all the time.

In the knob with a display function of this embodiment, the chassis 1 has a light guide ring 2 sheathed on and installed around the periphery of the chassis 1, and electrically coupled to the control circuit board 6. Specifically, the light guide ring 2 sequentially turns on or off the light according to the functions or parameters setting from external control elements, which associated with the knob through a connection terminal 11, and the light emission of the light guide ring 2 facilitates users to identify the selected function and allows users to observe the condition of the knob in a dark environment.

Figure 4:
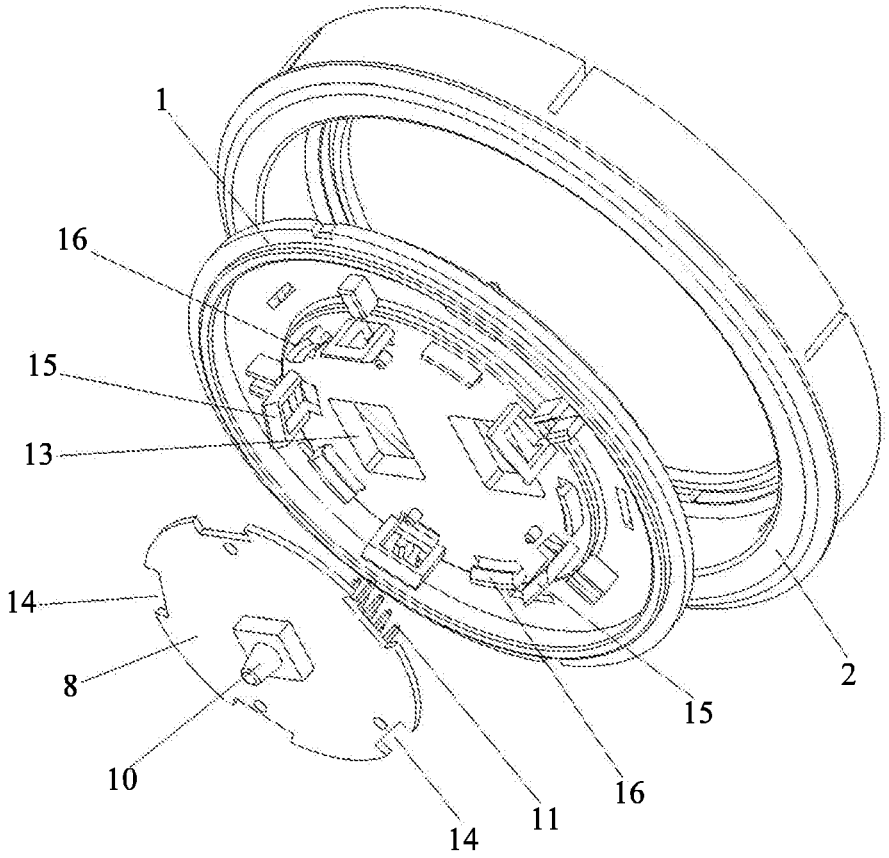
FIG. 4 is an exploded view of a functional connection board, a chassis, and a light guide ring in accordance with of the present invention.

In the knob with a display function of this embodiment as shown in FIG. 4, the chassis 1 has a connection hole 13 formed thereon for passing through the connection terminal 11 connection hole 13. Specifically, the connection hole 13 makes it easier to pass the connection terminal 11 through in order to connect the corresponding electronic products or electric appliances.

In the knob with a display function of this embodiment as shown in FIG. 4, the functional connection board 8 has at least three positioning notches 14 arranged with a gap apart from each other and positioned around the functional connection board 8, and the chassis 1 has at least three positioning blocks 15 configured to be corresponsive to the positioning notches 14 respectively, and the chassis 1 further has a buckle 16 for fastening the functional connection board 8. Specifically, at least three positioning blocks 15 are configured to be corresponsive to the positioning notches 14 respectively to make sure that the functional connection board 8 is accurately mounted onto the chassis 1. Further, the buckle 16 provides fastening function to the functional connection board 8 and preventing the functional connection board 8 from being loosened effectively. Preferably, all of the positioning notches 14, positioning blocks 15 and buckles 16 come with odd number quantities to assure the stability of the functional connection board 8.

Figure 3:
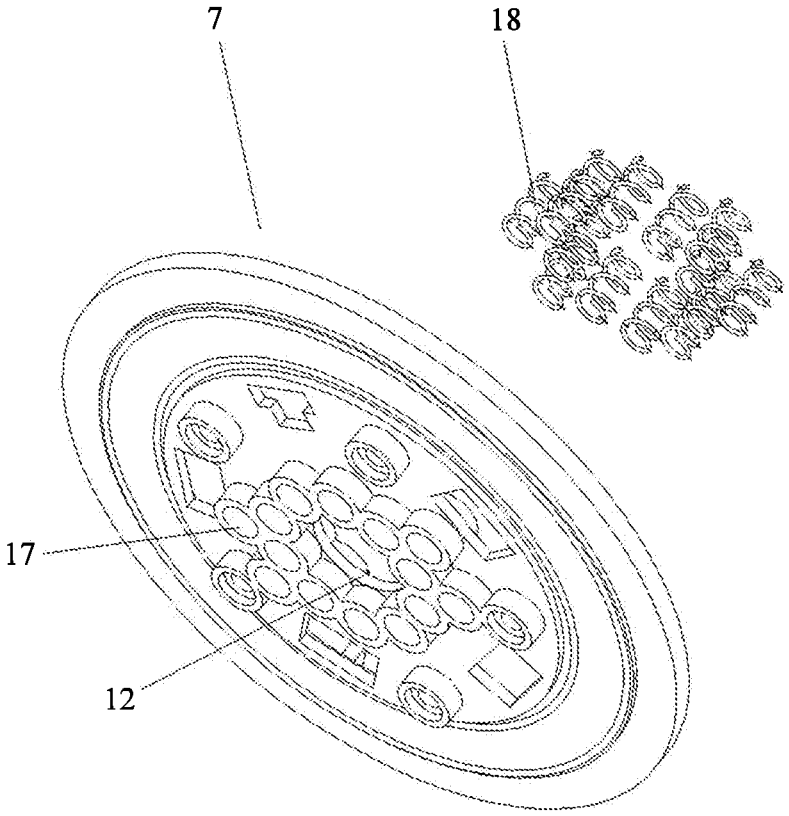
FIG. 3 is a schematic view of a reset device of the present invention.

In the knob with a display function of this embodiment as shown in FIG. 3, the reset device 7 has a plurality of positioning sockets 17 distributed uniformly thereon, and each positioning socket 17 has an elastic reset element 18 installed therein, and the elastic reset element 18 has an end coupled to the control circuit board 6 and the other end coupled to the functional connection board 8. Specifically, the resilience of the elastic reset element 18 assures that the control circuit board 6 can resume its original position after the confirm button 10 is pressed, so as to prevent the control circuit board 6 from being abutted and connected by the confirm button 10 or prevent a function from being selected all the time. Wherein, the uniformly distributed positioning sockets 17 and elastic reset elements 18 assures the reliability and accuracy of resuming the position of the control circuit board 6. In addition, the positioning socket 17 is provided for positioning the elastic reset element 18 to assure the reliability of its use.

Figure 2:
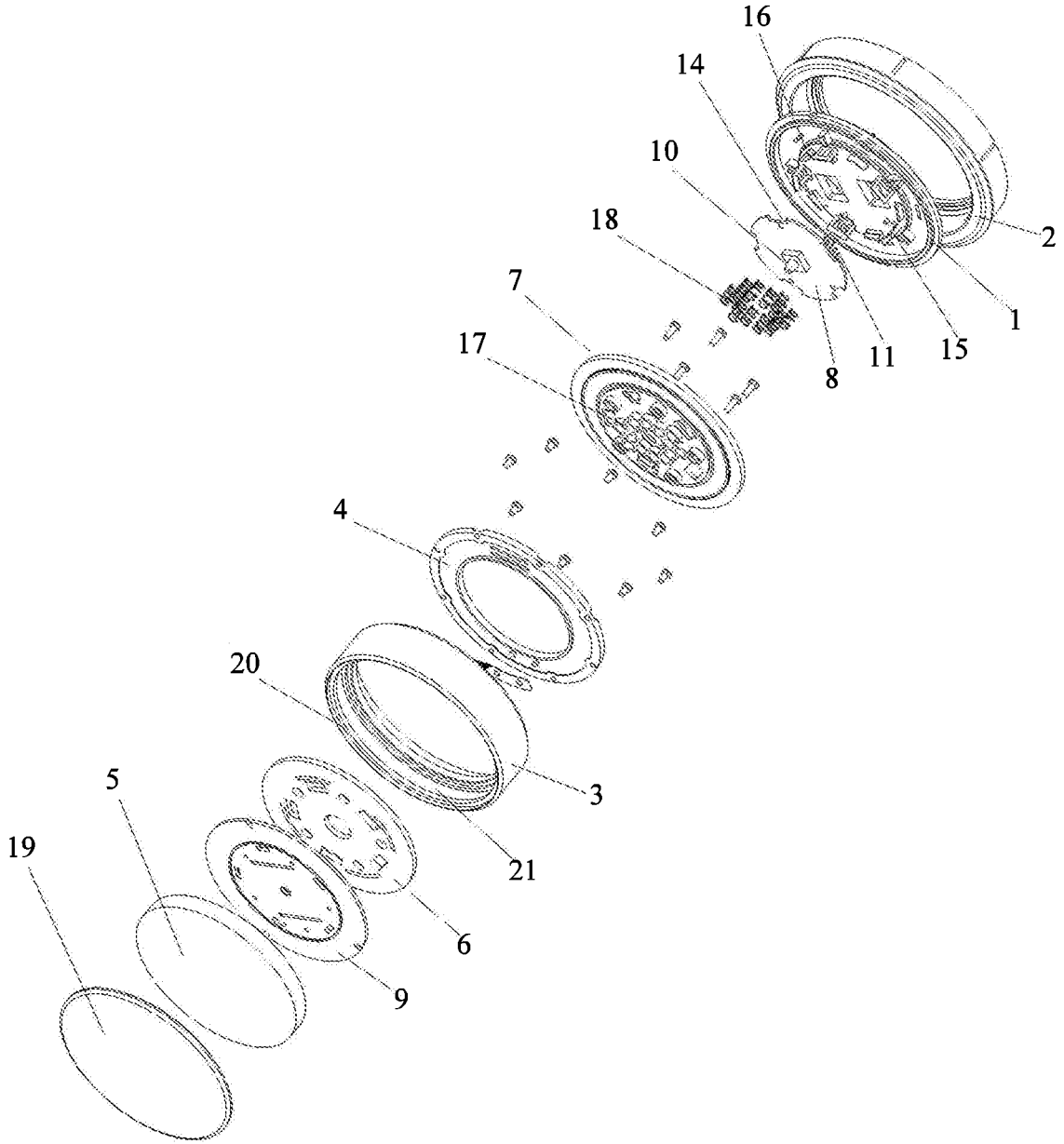
FIG. 2 is an exploded view of a knob with a display function in accordance with the present invention.

In the knob with a display function of this embodiment as shown in FIGS. 1 and 2, the display screen 5 has a transparent cover 19 installed thereon, and the knob ring 3 has an annular ridge 20 configured therein for preventing the transparent cover 19 from falling off. Specifically, the transparent cover 19 provides protection to the display screen 5, and preventing the display screen from being damaged by pressing the display screen 5 for a longtime, as well as preventing water vapor or liquid lamp from contaminating the display screen 5, and the transparent cover 19 provides users to view the displayed content of the display screen 5 easily. The transparent cover may be made of glass or other transparent materials, and the annular ridge 20 assures the stability and reliability of the installation of the transparent cover 19 and prevents the transparent cover 19 from falling off.

In the knob with a display function of this embodiment as shown in FIG. 2, the knob ring 3 has an annular groove 21 formed therein and provided as a moving space of the circuit board bracket 9. Specifically, the annular groove 21 provides the moving space for the circuit board bracket 9, so that the circuit board bracket 9 can be moved freely when the users press the display screen 5. In addition, the control circuit board 6 and the confirm button 10 can be touched easily and the position of the control circuit board 6 can be resumed easily.

In the knob with a display function of this embodiment as shown in FIG. 1, the chassis 1 has a plug column 22 configured at the bottom of the chassis 1, a plug block 23 configured symmetrically on each of both sides of the plug column 22, and a hook portion 24 configured on each plug block 23. Specifically, when it is necessary to install the knob of the present invention to an electronic product or an electric appliance, the plug column 22 is provided for positioning the installation position of the knob, and the hook portion 24 of the plug block 23 is provided for hooking a corresponding position of the electric appliance, and no screws are used to lock the knob of the invention to an electronic product or an electric appliance. Obviously, an accurate installation can be achieved easily and conveniently.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

What is claimed is:

1. A knob with a display function, comprising:

a knob operating unit including a chassis, and a knob ring rotatably coupled to the chassis, a rotary sensor coupled to the knob ring, and the chassis comprising a display screen;

a switch mechanism unit including a control circuit board, a reset device and a functional connection board sequentially installed on the chassis; a circuit board bracket installed between the display screen and the control circuit board, and both of the display screen and the control circuit board being fixed to the circuit board bracket, and the circuit board bracket being movably sheathed and coupled into the knob ring;

an operational button is configured on the functional connection board thereof, and a connection terminal is disposed at the back of the functional connection board and electrically coupled to the operational button;

the reset device having a through hole for extending the operational button to the outside, an end abutting and connecting the control circuit board, and the other end abutting and connecting the functional connection board;

and the display screen and the rotary sensor being electrically coupled to the control circuit board.

2. The knob with a display function according to claim 1, wherein the chassis has a light guide ring sheathed on and installed around the periphery of the chassis.

3. The knob with a display function according to claim 1, wherein the chassis has a connection hole formed thereon for passing through the connection terminal.

4. The knob with a display function according to claim 1, wherein the functional connection board has at least three positioning notches arranged with a gap apart from each other and disposed around the functional connection board, and the chassis has at least three positioning blocks disposed thereon and configured to be corresponsive to the positioning notches respectively, and the chassis further has a buckle for fastening the functional connection board.

5. The knob with a display function according to claim 1, wherein the reset device has a plurality of positioning sockets distributed uniformly thereon, and each positioning socket has an elastic reset element installed therein, and the elastic reset element has an end coupled to the control circuit board and the other end coupled to the functional connection board.

6. The knob with a display function according to claim 1, wherein the display screen has a transparent cover installed thereon, and the knob ring has an annular ridge disposed therein for preventing the transparent cover from falling off.

7. The knob with a display function according to claim 1, wherein the knob ring has an annular groove formed therein and provided as a moving space of the circuit board bracket.

8. The knob with a display function according to claim 1, wherein the chassis has a plug column disposed at the bottom of the chassis, a plug block disposed symmetrically on each of both sides of the plug column, and a hook portion disposed on each plug block.

* * * * *